US006155810A

United States Patent [19]

Thim

[11] Patent Number: 6,155,810

[45] Date of Patent: Dec. 5, 2000

[54] MOULD BED FOR MANUFACTURING PRE-STRESSED CONCRETE ELEMENTS

[75] Inventor: Stig Thim, Växjö , Sweden

[73] Assignee: Abetone Teknik AB, Vaxjo, Sweden

[21] Appl. No.: 09/125,172

[22] PCT Filed: Feb. 14, 1997

[86] PCT No.: PCT/SE97/00243

§ 371 Date: Nov. 17, 1998

§ 102(e) Date: Nov. 17, 1998

[87] PCT Pub. No.: WO97/33734

PCT Pub. Date: Sep. 18, 1997

[30] Foreign Application Priority Data

Mar. 11, 1996 [SE] Sweden ..... 9600938

[51] Int. Cl.[7] ..... B28B 7/02

[52] U.S. Cl. ..... 425/111; 264/228; 264/229

[58] Field of Search ..... 425/111; 264/228, 264/229

[56] References Cited

U.S. PATENT DOCUMENTS

| | | | |
|---|---|---|---|
| 3,568,274 | 3/1971 | Hidden et al. | 425/111 |
| 4,758,393 | 7/1988 | Cazenave et al. | 264/71 |
| 5,404,827 | 4/1995 | Baltz et al. | 105/282.3 |

FOREIGN PATENT DOCUMENTS

| | | |
|---|---|---|
| 2 644 722 | 9/1990 | France . |
| 2 303 487 | 8/1974 | Germany . |

OTHER PUBLICATIONS

Merriam–Websters Collegiate Dictionary, 10th Edition. 1999. Merriam–Webster Inc. p. 1103.

*Primary Examiner*—Tim Heitbrink
*Assistant Examiner*—Donald Heckenberg
*Attorney, Agent, or Firm*—Sughrue, Mion, Zinn, Macpeak & Seas, PLLC

[57] ABSTRACT

A mold bed for fabricating pre-stressed concrete elements has a mold frame (8) that extends between the ends of the bed. Tensioning heads are mounted at the bed ends for tensioning reinforcement ropes or lines (10) extending in the mold cavity. The mold frame (8) includes longitudinally extending beam elements (4) that take up pressure forces which constitute counter-pressure forces that are generated by the tension forces that are taken up by the tensioning heads when tensioning the ropes. These beam elements have the form of long bars (4), e.g., bars of rectangular profiles, that are surrounded by continuously or discontinuously extending sleeve elements (5). The bars (4) are therewith prevented from buckling or breaking sideways as a result of the pressure forces generated by the tension in the ropes (10). The sleeve elements (5) are stiffened by means of anchoring devices (14) that engage in the underlying surface. A layer or coating of nylon for instance is applied between the bars (4) and the sleeve elements so as to facilitate relative movement between the bars and the sleeve elements. Alternatively, wheels or rollers may be used to this end.

3 Claims, 2 Drawing Sheets

MOULD BED FOR MANUFACTURING PRE-STRESSED CONCRETE ELEMENTS

FIELD OF INVENTION

The present invention relates to a mould bed for manufacturing pre-stressed concrete elements.

SE-A-7705021 and SE-A-7812505 (both in the name of A-Betong) and U.S. Pat. No. 4,201,711 (Thomsen, et al) and U.S. Pat. No. 4,290,991 (Thim) disclose examples of mould beds for the manufacture of pre-stressed concrete elements of considerable lengths, often lengths exceeding 100 m, which are then cut into shorter elements to provide railway sleepers.

The strong tension forces in the reinforcing ropes or lines are partially taken up by anchoring the tensioning heads at the ends of the mould, although the actual mould bed frame will also be subjected to compression forces that act along the full length of the mould.

With the intention of taking up these compression forces, hitherto known beds have included I-beams or H-beams, which result in comparatively large and cumbersome frame constructions that, in turn, make access to the actual mould bed—in which different elements to be moulded in the pre-stressed concrete elements are placed—difficult to achieve.

DESCRIPTION OF THE BACKGROUND ART

In addition to the aforementioned publications, reference can be made to German Patent Specification 223 011 (Carl Grähn) which describes a mould bed that is delimited by longitudinally extending beam elements that include triangular reinforcements.

DE-A-2 303 487 (Eduard Seidner Maschinenfabrik) describes a steel frame for fabricating pre-stressed, rod-like concrete elements, in which pressure elements extend along the mould with the intention of supporting the reinforcement ropes as they are tensioned. These pressure elements have the form of round beams that are braced by legs that extend at right angles from the mould and include round beam-receiving holes. These leg parts are spaced relatively far apart along the mould bed. It is not certain therefore that the leg parts will be able to prevent the round pressure-absorbing beams from buckling or fracturing as a result of sideways acting forces, particularly when the reinforcement lines or ropes are heavily tensioned.

OBJECTS OF THE INVENTION

One object of the present invention is to provide a more slender and less expensive pressure-relieved mould frame while eliminating the aforesaid drawbacks and other drawbacks related to known mould beds.

Another object of the invention is to provide a pressure-relieved mould bed that can be accessed more readily than known mould beds, i.e. a mould bed in which different elements and devices to be cast in the pre-stressed concrete elements can be placed more readily in the bed.

SUMMARY OF THE INVENTION

Because the inventive bed utilizes long rods or bars of an uncomplicated profile, e.g. a rectangular or round profile instead of the aforesaid I-beams or H-beams for relieving pressure in the bed, and because the sleeve elements prevent the rods from buckling or snapping sideways as a result of said pressure, there is obtained a more slender and less expensive mould frame.

The reduced dimensions of the mould frame in relation to known mould frames enables access to be achieved more readily, for instance for manually placing different types of devices and elements that are to be cast in the pre-stressed concrete elements.

The sleeve elements per se are conveniently stiffened through the medium of anchoring devices that grip in the underlying supporting surface, e.g. a concrete floor.

There may be disposed between the rods and the sleeve elements means that will facilitate relative movement therebetween. The means may, for instance, be comprised of a layer of low-friction material, e.g. nylon or Teflon, applied to the rods and/or to the sleeve elements.

The sleeve elements may extend either continuously or discontinuously along the mould bed. When the sleeve elements are discontinuous, one or more wheels or rollers for supporting a pressure-absorbing bar may be disposed in the spaces between mutually adjacent sleeve elements.

The sleeve elements need not, in practice, tightly embrace the uncomplicated bars that are to be stiffened against buckling or breaking. Instead, the sleeves may lightly surround the bars provided that spacer-like means are provided in the interspaces between the sleeves.

One particular advantage afforded by this arrangement is that, if so required, the sleeve elements can form an integral part of the mould bed and for this reason may have relatively large dimensions when, for instance, the concrete elements to be fabricated in the mould have large dimensions. The pressure-absorbing bars, on the other hand, need not have correspondingly large dimensions.

A device for anchoring the tensioning heads in an emergency and which is adapted to come into operation should the pressure relief system break down for some reason or other may also be provided. A breakdown may occur, for instance, if a truck runs over the beam elements surrounded by the sleeve elements in the mould bed so as to bend or break said beam elements.

So that further characteristic features of the invention and advantages afforded thereby will be more apparent, an inventive mould bed will now be described in more detail with reference to preferred embodiments thereof and also with reference to the accompanying drawings.

DETAILED DESCRIPTION OF PREFERRED EMBODIMENTS

Figure 1:
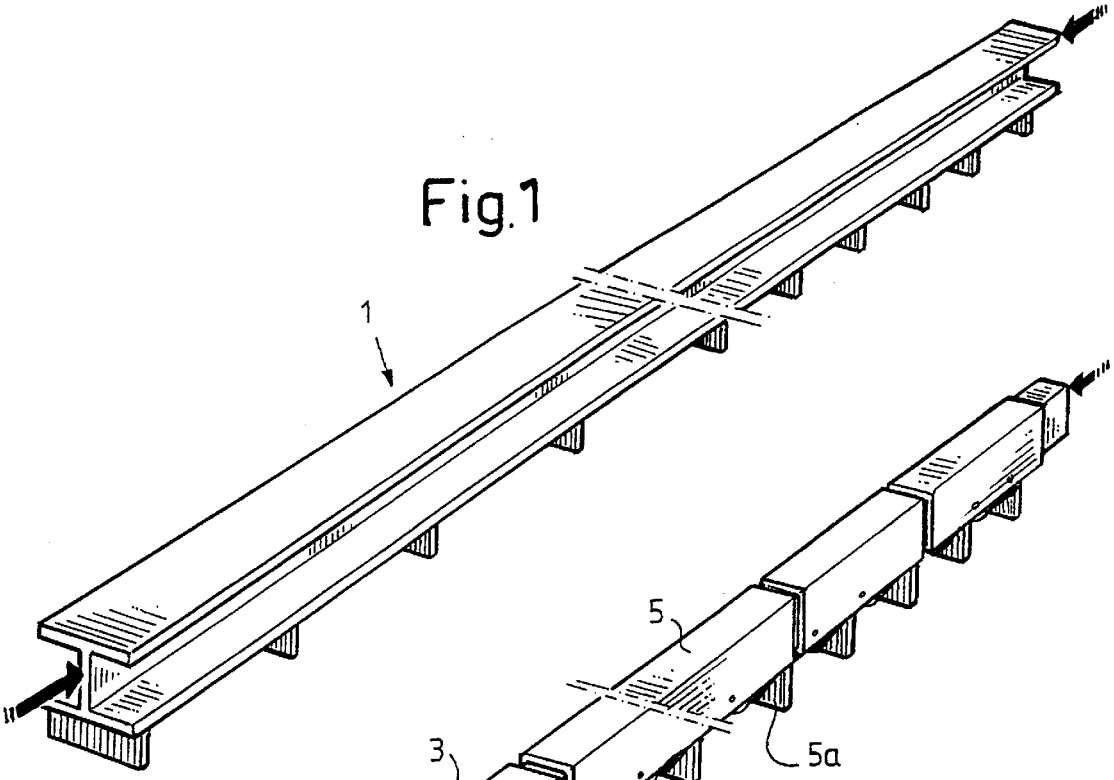
FIG. 1 is a perspective view of an I-beam or H-beam intended for use in a mould bed for the fabrication of concrete elements in accordance with the known state of the art.

FIG. 1 is a perspective view of an I-beam or H-beam intended for inclusion in the frame of a mould bed intended for moulding pre-stressed concrete elements, in accordance with the earlier state of the art. Reinforcing lines or ropes that extend in the mould cavity are tensioned by tensioning heads provided at the ends of the bed. The tensioning heads are, as a rule, anchored to the underlying bed supporting surface. Alternatively, the pressure forces to which the frame is subjected in a pre-stressing operation by means of an I-beam or H-beam 1 of the kind shown in FIG. 1 on each side of the mould bed in the mould frame.

The beam 1 is movably anchored to the underlying surface at discrete points, e.g. by means of floor-mounted bolts and oval holes in the foot supports.

Figure 2:
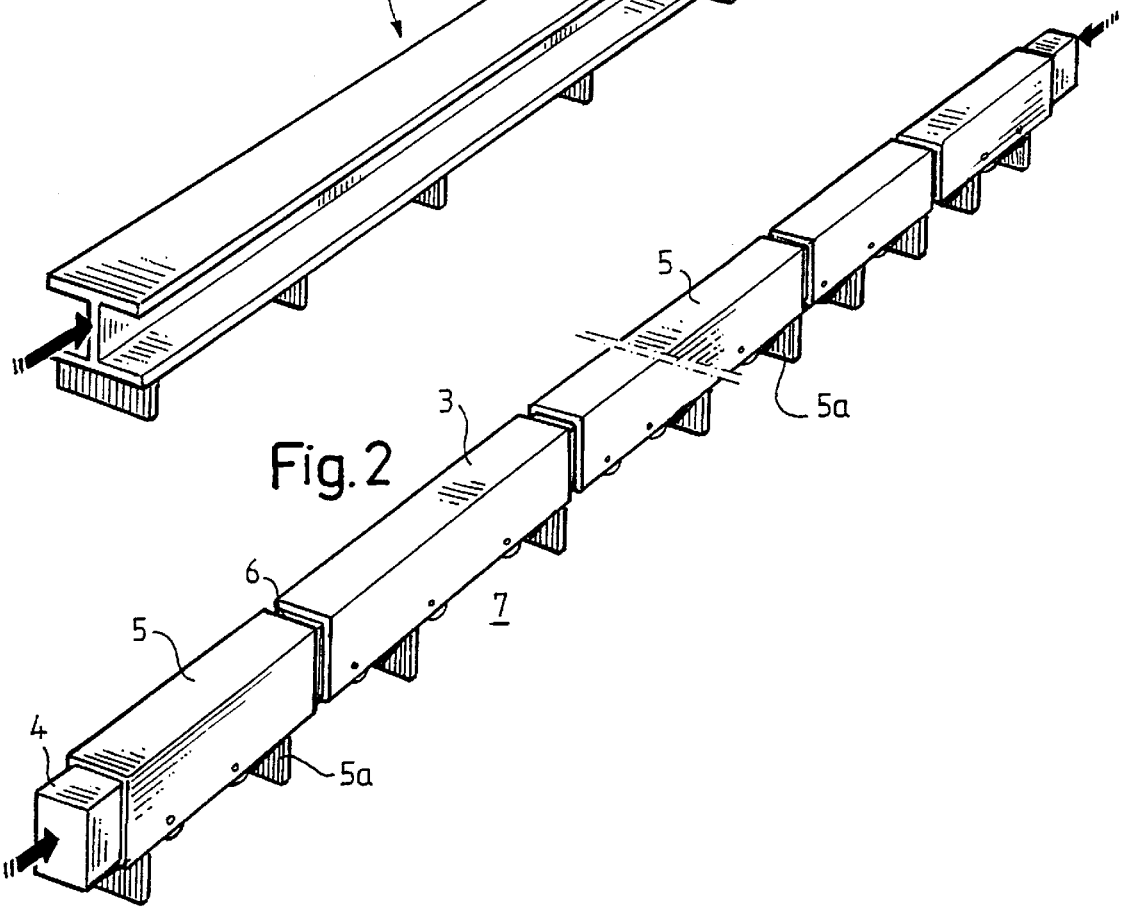
FIG. 2 is a perspective view of a pressure rod or bar intended for an inventive mould bed and surrounded by discontinuous sleeve elements.

FIG. 2 is intended to illustrate the principle construction of an inventive beam element used to the same end. The beam element is generally referenced 3 and consists of a long bar 4 of uncomplicated cross-section, in the illustrated case of rectangular cross-section. The bar 4 is shown to be surrounded by a sleeve element 5 that prevents the bar 4 from breaking or buckling laterally as a result of the pressure forces generated in the pre-stressing operation.

The sleeve element 5 of the FIG. 2 embodiment is discontinuous, i.e. spaces 6 are defined between the mutually adjacent parts of the sleeve element.

The sleeve element may alternatively extend continuously along the full length of the bar 4.

The non-tensioned sleeves 5 stiffen the relatively slender bar 4 against breaking or buckling, and are, in turn, stiffened by discrete anchorages 5*a* in the underlying surface, normally a concrete floor 7.

Figure 3:
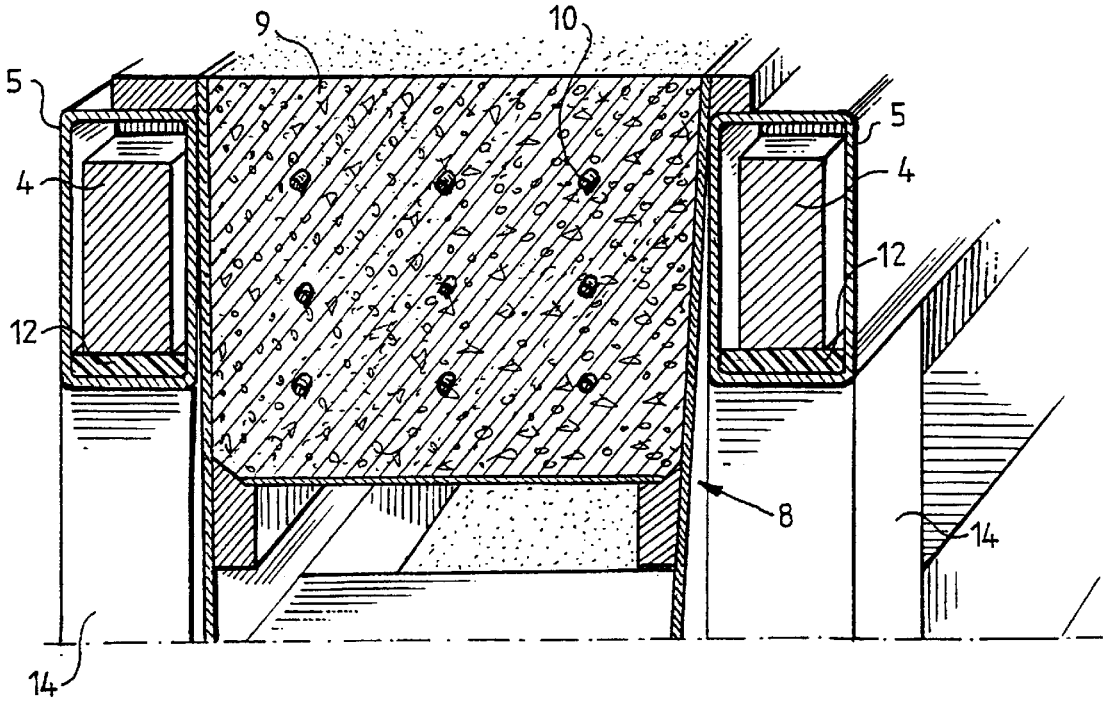
FIG. 3 is a perspective cross-sectional view of an inventive mould bed in which a pre-stressed concrete element begins to harden.

FIG. 3 is a perspective cross-sectional view of a frame 8 which delimits a mould bed for the fabrication of pre-stressed concrete elements 9 which, when hard, can be sawn into sleeper block lengths. The pre-tensioning lines or ropes are designated 10.

The frame 8 includes the pressure relieving sleeve elements 5, supported on anchoring device 14 corresponding to the anchorages 5*a* in FIG. 2. The sleeve elements 5 may optionally form an integral part of the mould bed itself, i.e. the sleeve elements may form side surfaces in the mould cavity.

The rectangular pressure-absorbing bars 4 have smaller dimensions than the sleeve elements 5. Spacer elements 13 may be disposed in the interspaces between the sleeve elements 5, to ensure that the desired rigidity against bending or breaking of the bars is achieved.

The sleeve elements 5 and/or the bars 4 may include a layer or coating of nylon, Teflon or some other low-friction material, to facilitate sliding of the bars and sleeve elements in relation to one another.

Figure 4:
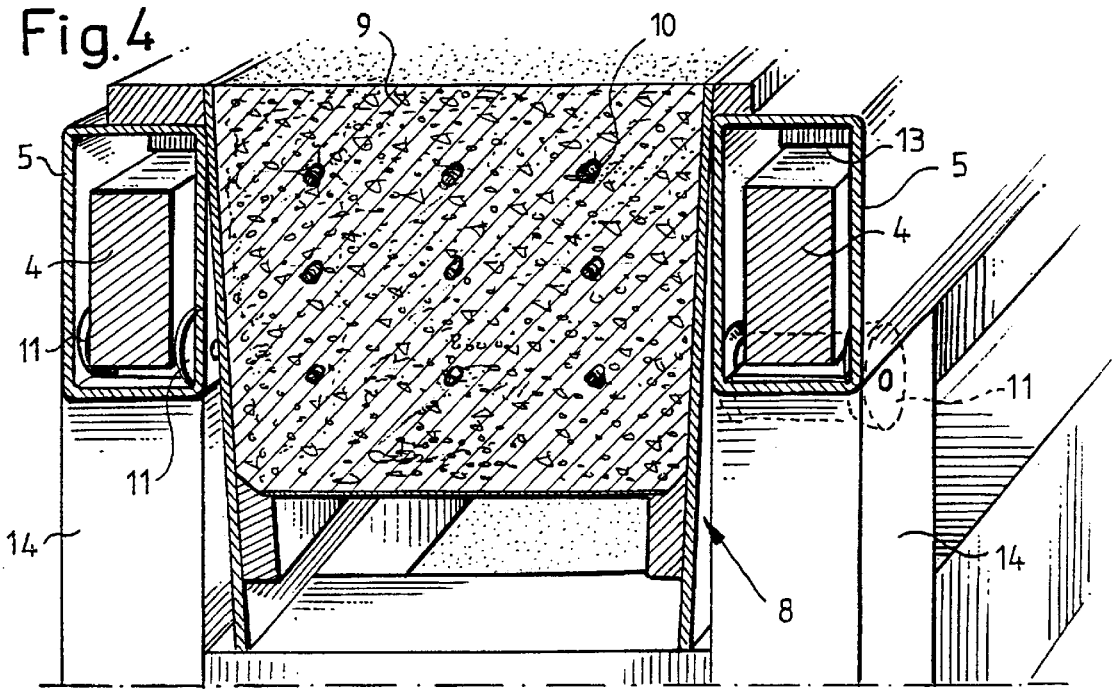
FIG. 4 is a perspective cross-sectional view corresponding to FIG. 3 and illustrates an alternative embodiment in which pressure rods or bars surrounded by sleeve elements are supported on rollers in the region of the bottoms of said sleeve elements.

FIG. 4 illustrates an alternative embodiment in which the bars 4 rest on wheels or rollers 11 in the region of the bottoms of respective sleeve elements 5, this arrangement being alternative to coating the bars with nylon, etc.

When the sleeve elements 5 are of the kind shown in FIG. 2, i.e. discontinuous, the rollers or wheels 11 may be disposed in the spaces 6 between mutually adjacent sleeve elements 5.

What is claimed is:

1. A mould bed for manufacturing pre-stressed concrete elements, comprising:

a) a mould frame (8) which extends along sides of the bed and beneath said bed;

b) tensioning heads disposed in a cavity of the mould at the ends of the bed for tensioning reinforcement rods (10);

c) tension head anchoring means; and d) beam elements (4) extending longitudinally in the frame for absorbing pressure forces acting as counter-pressure forces generated by tension forces taken up by the tensioning heads as the rods are pre-tensioned, wherein i) the longitudinally extending beam elements are long bars of uncomplicated rectangular or round profile, ii) the bars are surrounded by discontinuously extending sleeve elements (5) to prevent lateral buckling or breaking of the bars as a result of said pressure forces, iii) the sleeve elements are stiffened by anchoring devices (5*a*) that engage an underlying bed supporting surface, iv) means for facilitating relative movement between the bars and the sleeve elements are disposed between said bars and said sleeve elements, and v) bar-supporting wheels or rollers (11) are mounted in spaces between said sleeve elements.

2. A mould bed according to claim 1, wherein said movement facilitating means comprises a layer or coating (12) of low-friction material on the bars and/or on the sleeve elements.

3. A mould bed according to claim 1, wherein the sleeve elements have larger dimensions than the bars, and spaces between sleeve elements and bars is at least partially filled with intermediate spacers (13).

* * * * *